US008025386B2

(12) United States Patent
Yokoyama

(10) Patent No.: US 8,025,386 B2
(45) Date of Patent: Sep. 27, 2011

(54) INKJET RECORDING APPARATUS

(75) Inventor: Takeshi Yokoyama, Hachioji (JP)

(73) Assignee: Konica Minolta Medical & Graphic Inc., Tokyo (JP)

( * ) Notice: Subject to any disclaimer, the term of this patent is extended or adjusted under 35 U.S.C. 154(b) by 941 days.

(21) Appl. No.: 11/958,596

(22) Filed: Dec. 18, 2007

(65) Prior Publication Data

US 2008/0151029 A1 Jun. 26, 2008

(30) Foreign Application Priority Data

Dec. 26, 2006 (JP) ..... 2006-349346

(51) Int. Cl.
*B41J 2/01* (2006.01)

(52) U.S. Cl. ..... 347/102; 347/19

(58) Field of Classification Search ..... 347/102, 347/19

See application file for complete search history.

(56) References Cited

U.S. PATENT DOCUMENTS

2005/0018026 A1* 1/2005 Nerad et al. ..... 347/102
2005/0168509 A1* 8/2005 Yokoyama ..... 347/17
2005/0280683 A1* 12/2005 Custer ..... 347/102
2006/0050133 A1* 3/2006 Kokubo ..... 347/129
2008/0174650 A1* 7/2008 Nakazawa et al. ..... 347/102

FOREIGN PATENT DOCUMENTS

JP 2005-246955 A 9/2005
JP 2005-254560 A 9/2005
JP 2005254560 A * 9/2005

* cited by examiner

*Primary Examiner* — Matthew Luu
*Assistant Examiner* — Rut Patel
(74) *Attorney, Agent, or Firm* — Holtz, Holtz, Goodman & Chick, PC

(57) ABSTRACT

An inkjet recording apparatus having: a recording head including a nozzle row jetting ultraviolet curable ink on a substrate; and an LED light source including a plurality of LEDs disposed in the direction of the nozzle row, being electrically series-connected, and irradiating an ultraviolet light on ink having been jetted onto the substrate, wherein a total illuminance of two adjacent LEDs of the LED light source on a surface of the substrate is larger than an illuminance required for curing of the ink at an entire area of a section between each two adjacent LEDs, and a maximum of the total illuminance is set to be illuminance less than two times of a minimum of the total illuminance in the section between each two adjacent LEDs.

13 Claims, 7 Drawing Sheets

LEDS CONNECTED IN PARALLEL

LEDS SERIES-CONNECTED

FIG. 15 ( a )
LED CHIPS CONNECTED IN PARALLEL
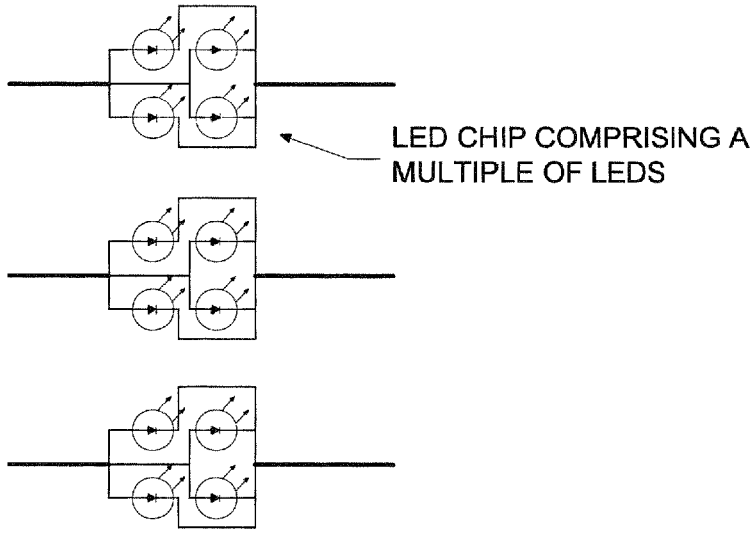
FIG. 15 ( b )
LDE CHIPS SERIES-CONNECTED
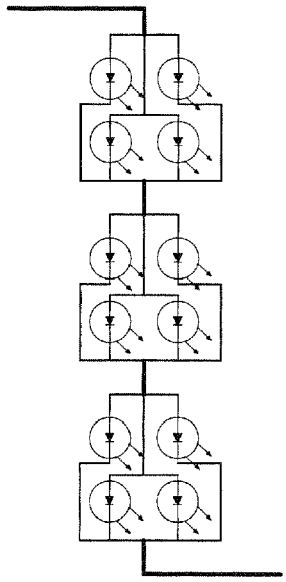

INKJET RECORDING APPARATUS

RELATED APPLICATION

This application is based on Japanese Patent Application NO. 2006-349346 filed on Dec. 26, 2006 in Japanese Patent Office, the entire content of which is hereby incorporated by reference.

FIELD OF THE INVENTION

The present invention relates to an inkjet recording apparatus and in particular to an inkjet recording apparatus in which light is irradiated on photocurable ink and then the ink is cured and fixed on a substrate.

DESCRIPTION OF THE RELATED ART

Image recording apparatuses that can record images not only on commonly used material such as paper and fabric, but also on materials that have poor ink absorbency such as resin films and the like, have been developed. An example is one in which ink is jetted from a nozzle that is provided on an end surface of the recording head, and this technology is currently being used in various technical fields. Of these, there has been advancement in the photocure type inkjet recording apparatus in which ultraviolet light and the like is irradiated onto ink that has been jetted onto a substrate and then the ink is cured and fixed.

In this type of photocure type inkjet recording apparatus, because the ink can be easily absorbed and favorable recording materials can be obtained, UV curable ink which is cured by ultraviolet irradiation is often used.

In addition, high pressure mercury lamps, metal halide lamps and the like have been used heretofore as the light source for curing the UV curable ink, but in recent years LED (Light Emitting Diode) light sources have been attracting much attention as a light source due to merits of a long life span and because they can light up instantaneously, and inkjet recording apparatuses which use these LED light sources as the ultraviolet light source are being developed (For example, Japanese Unexamined Patent Application Publication No. 2005-246955 and Japanese Unexamined Patent Application Publication No. 2005-254560 publication).

However, the LED light source has the structure in which a multiple of single LED light sources are arranged in a row. In this case, due to variation in the LED illuminance intensity, intensity at the position on the substrate surface that is at a position on a LED with low illuminance intensity becomes relatively low, and it becomes difficult for the photocurable ink that has been jetted onto the substrate to be cured. In Japanese Unexamined Patent Application Publication No. 2005-246955, the intensity of each LED is adjustable and the intensity at positions on the substrate is even. However, because heavy current must be sent to the LED which emits ultraviolet light, in order to adjust the illuminance intensity of each LED individually, LED are connected in parallel (FIG. 10), and each LED requires a control circuit controlling a drive current and the actual number of thick cables equal to the number of LEDs and thus the device becomes complex.

Furthermore, if the distance between adjacent LEDs is short, the irradiation intensity is relatively low at the middle position of two adjacent LEDs on the surface of the substrate (recording surface), or in other words, at the position on the substrate surface that opposes the middle position of two adjacent LEDs, and curing of the UV curable ink jetted on the substrate becomes difficult. It is to be noted that, the LED light source is often structured as a multiple series of single LED light sources. In this case, when the distance between adjacent LEDs is long, the irradiation intensity is relatively low at the middle position of two adjacent LEDs on the surface of the substrate (recording surface), or in other words, at the position on the substrate surface that opposes the middle position of two adjacent LEDs, and curing of the UV curable ink jetted on the substrate becomes difficult.

Thus, if the irradiation intensity at the substrate surface which has become relatively small at the middle position between the two LEDs is adjusted, for example, to be the minimum intensity for curing of the ink jetted on the substrate, the ink is cured at that position. On the other hand, illuminance becomes relatively high immediately below the LED, and at this portion, the surface energy of the ink jetted on the substrate becomes high and the smoothness of the ink surface and wetness are improved, and next this facilitates spreading of ink jetted onto this ink on the surface. For this reason, jetted ink is first spread on the ink and the brightness of that portion is increased.

In this manner, in the case where ultraviolet curable ink, for example, is jetted from all the nozzles of the inkjet recording apparatus and so-called solid image recording is performed and the ink is cured, there is brightness at recording portion of the substrate right under the LED and the density becomes high, but the brightness of the ink is reduced and the density also becomes low at the recording position of the substrate corresponding to the middle position between adjacent LEDs. For this reason, striped unevennesses appear in the brightness or concentration of the substrate surface.

In order to solve these problems, making the LEDs of the LED light source adjacent and making the illuminance distribution on the substrate as even as possible has been considered. However, in current LED light sources, because the amount of heat generated from the LED along with light emission is large, if the LEDs are brought to close to each other, the lifespan of the LED itself is reduced due to heat. In addition, there are problems in that the temperature of the radiation device becomes high and this is dangerous and also has adverse effects on the device.

SUMMARY OF THE INVENTION

The object of the present invention is to provide an inkjet recording apparatus in which no light unevenness or density unevenness is generated in the inkjet recording medium using this type of LED light source, and in which heat generated by the LED light source does not have an adverse effect.

One aspect of the present invention is an inkjet recording apparatus comprising: a recording head including a nozzle row jetting ultraviolet curable ink on a substrate; and an LED light source including a plurality of LEDs disposed in the direction of the nozzle row, being electrically series-connected, and irradiating an ultraviolet light on ink having been jetted onto the substrate, wherein a total illuminance of two adjacent LEDs of the LED light source on a surface of the substrate is larger than an illuminance required for curing of the ink at an entire area of a section between each two adjacent LEDs, and a maximum of the total illuminance in the section between each two adjacent LEDs is set to be less than two times of a minimum of the total illuminance in the section between each two adjacent LEDs.

Another aspect of the present invention is an inkjet recording apparatus comprising: a recording head including a nozzle row jetting ultraviolet curable ink on a substrate; and an LED light source including a plurality of LEDs disposed in the direction of the nozzle row, being electrically series-connected, and irradiating an ultraviolet light on ink having been jetted onto the substrate, wherein, an illuminance at a middle point between each two adjacent LEDs of the LED light source on a surface of the substrate is larger than an illuminance required for curing of the ink, and an illuminance at each of the two adjacent LEDs on the surface of the substrate is set to be an illuminance less than two times of the illuminance at the middle point between the two adjacent LEDs.

Another aspect of the present invention is an inkjet recording apparatus comprising: a recording head including a nozzle row jetting ultraviolet curable ink on a substrate; and an LED light source including a plurality of LEDs disposed in the direction of the nozzle row, being electrically series-connected, and irradiating an ultraviolet light on ink having been jetted onto the substrate, wherein a range in which the LED light source irradiates ultraviolet light is disposed so as to be larger than the recording width on the substrate set by the nozzle row on the recording head, and wherein the LED light source irradiates ultraviolet light so that a minimum of illuminance of the LEDs on a surface of the substrate is larger than an illumination required for curing of the ink, and that a maximum of illuminance of the LEDs on a surface of the substrate is set to be less than two times of the minimum of illuminance in the recording width.

BRIEF DESCRIPTION OF THE DRAWINGS

FIG. 15(*a*) shows a circuit in which the LED chips are connected in parallel and FIG. 15(*b*) shows a circuit in which the LED chips are series-connected.

DESCRIPTION OF THE PREFERRED EMBODIMENTS

The following is a description of an embodiment of the inkjet recording apparatus of the present invention with reference to the drawings.

It is to be noted that in the embodiment, the case where the inkjet recording apparatus is the serial head type is described, but as described hereinafter, the present invention may also be used in the line head type inkjet recording apparatus.

Figure 1:
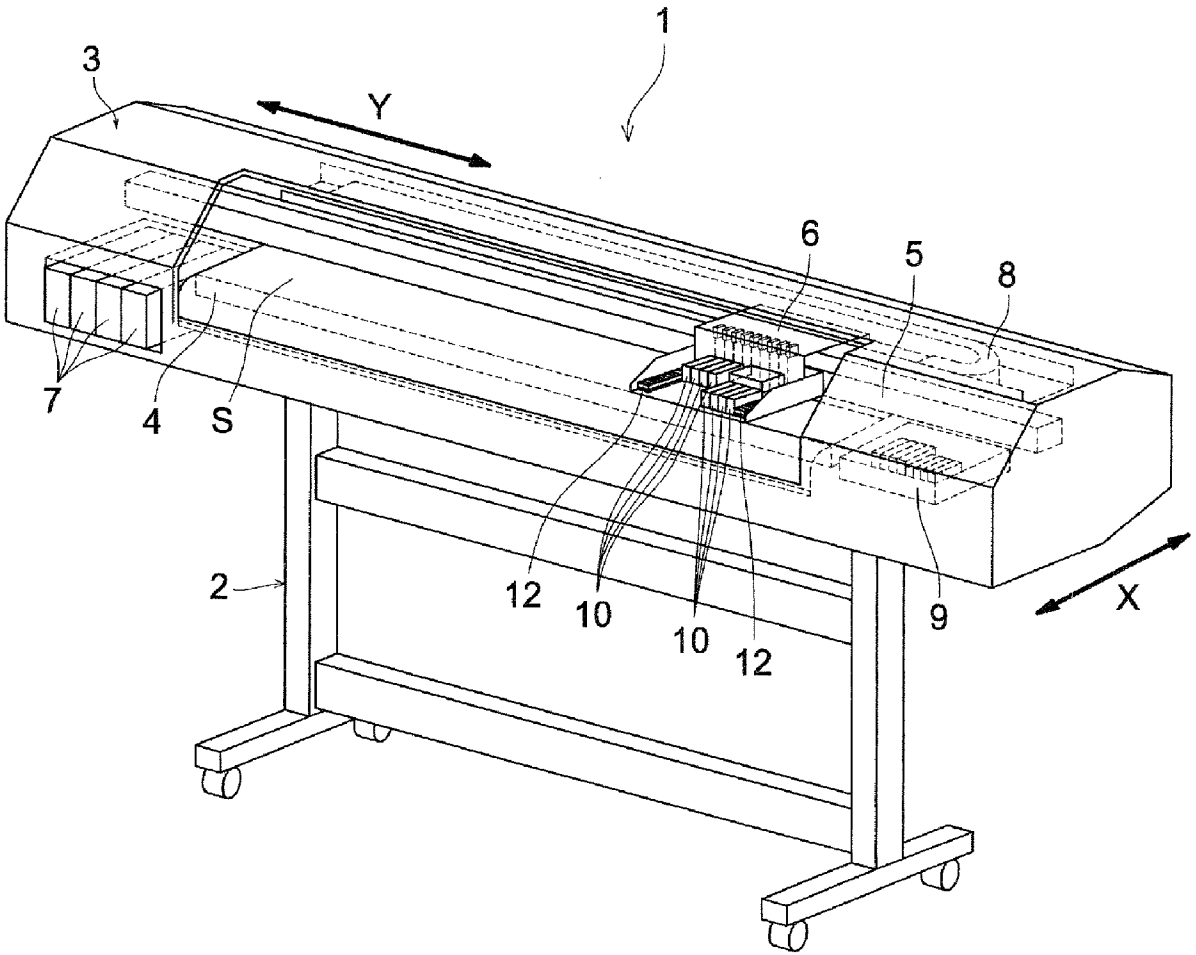
FIG. 1 shows the structure of the inkjet apparatus according to the embodiment.

As shown in FIG. 1, the inkjet recording apparatus 1 according to the embodiment comprises a printer main body 3 that is supported on a support table 2. A flat platen 4 which supports the substrate S of the recording paper or the like from the non-recording surface side is provided substantially horizontally in the printer main body 3. Conveyance rollers and follow rollers (not shown) which convey the substrate S in the sub scanning direction X are provided at the upstream side and downstream side respectively in the sub scanning direction which is shown by arrow X in the diagram of platen 4.

The conveyance roller is driven so as to rotate intermittently at a prescribed amount at a time by the conveyance motor that is not shown, and the substrate S is intermittently conveyed in the sub scanning direction X while repeating moving and stopping of the substrate S due to rotation of the conveyance roller. It is to be noted that structure is possible in which an endless conveyor belt (not shown) is stretched between the conveyance rollers and the follow rollers for example, and the substrate S is conveyed in state where it is carried on the conveyor belt on the upper side of the platen 4.

There is a rod-like guide rail 5 above the platen 4, and a substantially case-like carriage 6 is supported by the guide rail 5. The carriage 6 is moved back and forth along the guide rail 5 in the main scanning direction shown by the arrow Y in the drawing, by a driving mechanism that is not shown.

There are ink tanks 7 which store inks of different colors that are jetted from the recording head 10 which is described hereinafter, at one end side in the main scanning direction Y of platen 4, and ink is supplied to the recording head 10 from the ink tank 7 via the flexible tube 8. Also, there is a maintenance unit 9 for cleaning the recording head 10 at the other end side in the main scanning direction Y of platen 4.

Figure 2:
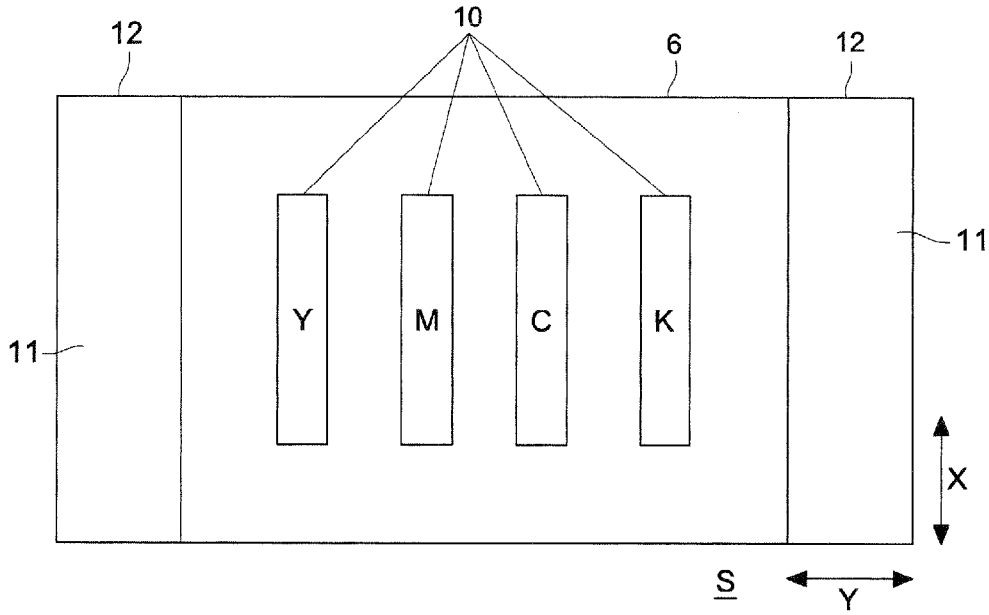
FIG. 2 is a top view showing the structure of the cartridge of the inkjet recording apparatus.

As shown in the top view of FIG. 2, the carriage 6 is loaded such that a plurality of recording heads 10 are provided in parallel in the main scanning direction Y, and each recording head 10 scans the substrate S in accordance with the back and forth movement in the main scanning direction Y of the carriage 6 along the guide rail 5. It is to be noted that FIG. 2 shows the case where the recording heads 10 and the LED light source 12 have the simplest arrangement, but other arrangements are possible.

Figure 3:
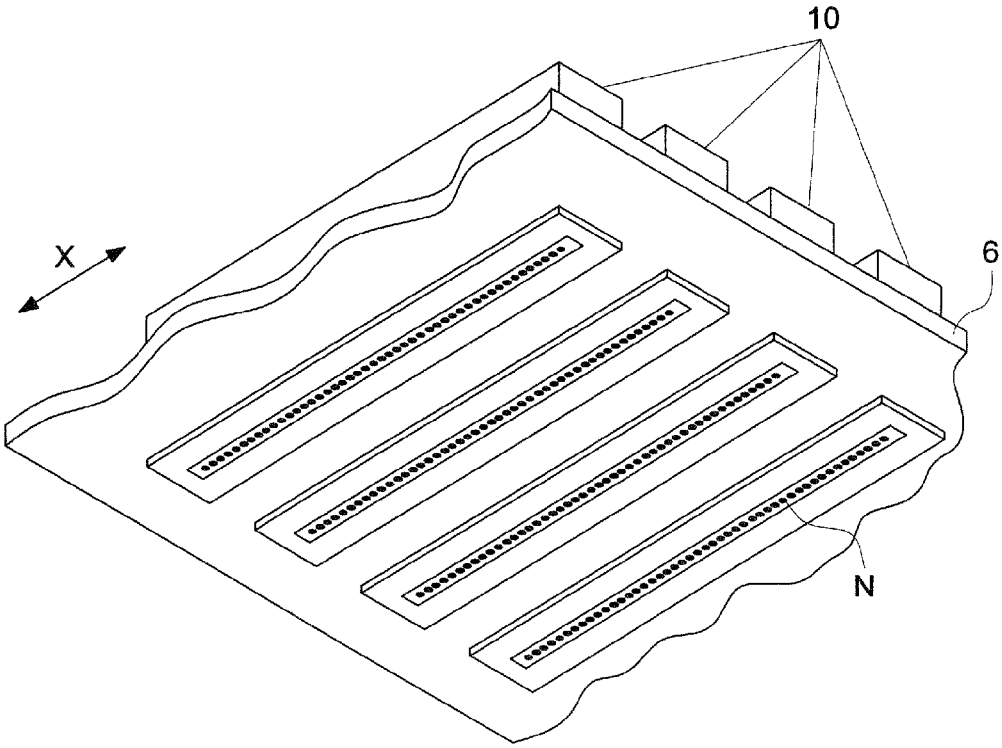
FIG. 3 is perspective view of the carriage from above and shows the nozzle of the recording head.

As shown in FIG. 3, a plurality of nozzles N are provided at the lower surface, namely the surface opposing the substrate S, of the plurality of recording heads 10, the plurality of nozzles N form nozzle rows that extend in the sub scanning direction X.

The recording heads 10 have piezoelectric elements (not shown) which correspond to the each of the nozzles N and the piezoelectric elements deform due to electrostriction in accordance with the waveform applied, and ink is jetted from each of the nozzles N respectively by increasing the pressure inside the ink chamber that is formed in the background of the nozzle N. The piezoelectric element used in the embodiment is one which can adjust the degree of deformation in accordance with the applied waveform and by changing the waveform to be applied, the amount of ink jetted from the nozzle N, or in other words, the amount of droplets for one drop of ink can be adjusted.

It is to be noted that the piezoelectric element may be replaced by a heat generating element for example, and in this case, by changing the waveform applied to the heat generating element, the degree of growth of the air bubbles that form and grow in the ink due to heating of the heat generating element can be adjusted and thus the amount of ink jetted from the nozzle can be adjusted. In addition, the structure may also be such that the so-called multi-drop type recording head is used as the recording head, and by changing the number of drops of ink jetted from the nozzle, the amount of ink jetted from the nozzle is adjusted.

In the embodiment, yellow (Y), magenta (N), cyan (C), and black (K) ink are supplied to the corresponding recording heads 10 from the ink tanks 7 which store inks of the respective colors and each nozzle located at one recording head 10 jets ink of the same color. It is to be noted that it is not only the process color inks mentioned above that are jetted, but non-process color inks such as white ink and clear ink, or special color inks such as orange or violet may be jetted.

As described above, the ink jetted from the nozzle of the recording head 10 is the ultraviolet light curable type which cures when irradiated with ultraviolet light, and the main components include at least polymerizable compounds comprising known polymerizable compounds, photo-initiator, and a colorant. A pigment is preferably used as the colorant in view of resistance to weather. It is to be noted that it may be unnecessary to use the photo-initiator depending on the composition of the ink.

In addition, the ultraviolet light curable type ink preferably uses a radical polymerizable ink including a radical polymerizable compound as the polymerizable compound, and a cation polymerizable ink including a radical polymerizable compound. It is also possible to use a hybrid ink in which the radical polymerizable ink and the cation polymerizable ink are both combined. It is to be noted that if a cation polymerizable ink is used, inhibition of the polymerization reaction due to oxygen is reduced or eliminated, and functional properties and application is excellent. More specifically, examples of the cation polymerizable ink used in the embodiment include mixtures including at least a cation polymerizable compound such as oxetane compound, an epoxy compound, or vinyl ether compound; a photo-cation initiator; and a pigment, and has the property of being cured by irradiation of ultraviolet light.

Both ends in the main scanning direction of the carriage 6 respectively, have an LED light source 12 as the ultraviolet irradiation device which has a case-like cover member 11 which is open at the substrate side, and a plurality of LEDs which emit ultraviolet light are arranged in the sub scanning direction X inside the LED light source 12.

Figure 4:
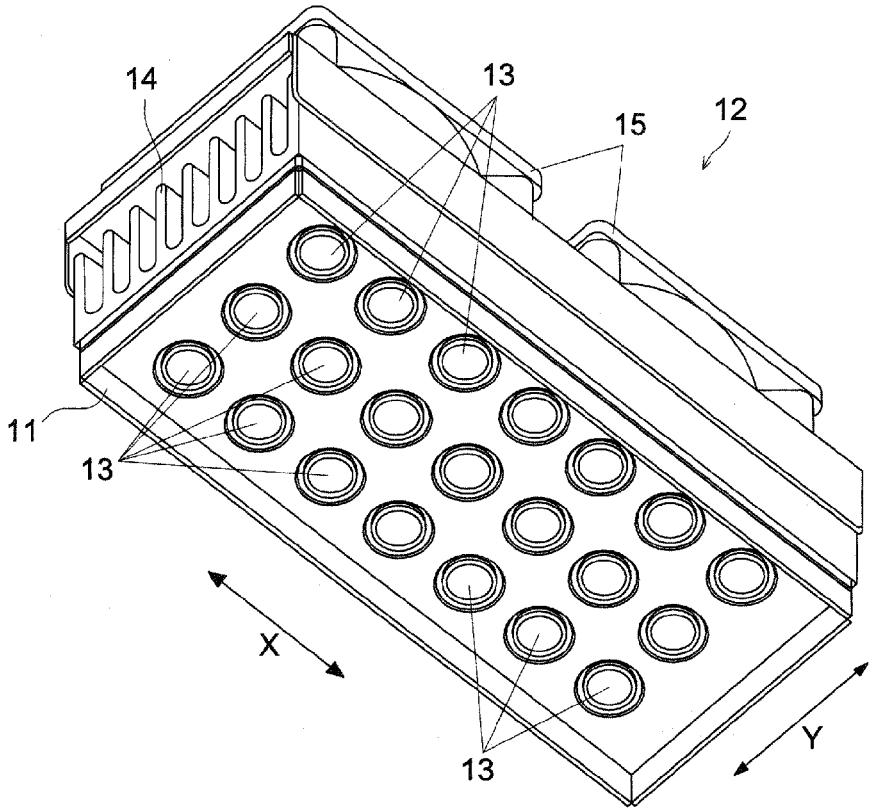
FIG. 4 is a perspective view showing the structure of the LED light source viewed from below.

More specifically, as shown in FIG. 4, the LED light source 12 comprises a cover member 11 for shielding such that the ultraviolet light does not escape to the outside Inside the open portion of the cover member 11, a plurality of LEDs 13 as an ultraviolet light source which irradiates ultraviolet onto the ink that were jetted onto the substrate S are arranged in a row in the sub scanning direction X. It is to be noted that in FIG. 4, a plurality of rows of the LEDs 13 are arranged in the main scanning direction Y, but the arrangement of the LEDs 13 is not limited to this arrangement, and for example, one row may be arranged along the sub scanning direction X. In addition, in FIG. 4, each LED 13 is shown to be larger than the actual size of the LED light source 12.

In addition, at the surface opposite to the opening of the cover member 11, there is a heat sink 14 for radiating heat generated from the light source. Also there is a cooling fan 15 for forcibly releasing heat radiated by the heat sink 14 at the side opposite to the side where the heat sink 14 and the cover member 11 are connected. It is to be noted that the heat sink 14 and the cooling fan 15 may be replaced by a mechanism that radiates heat by circulating liquid such cold water or a cooling mechanism that uses a Peltier element of the like.

The structure of the LED light source 12 will be described in the following.

Figure 5:
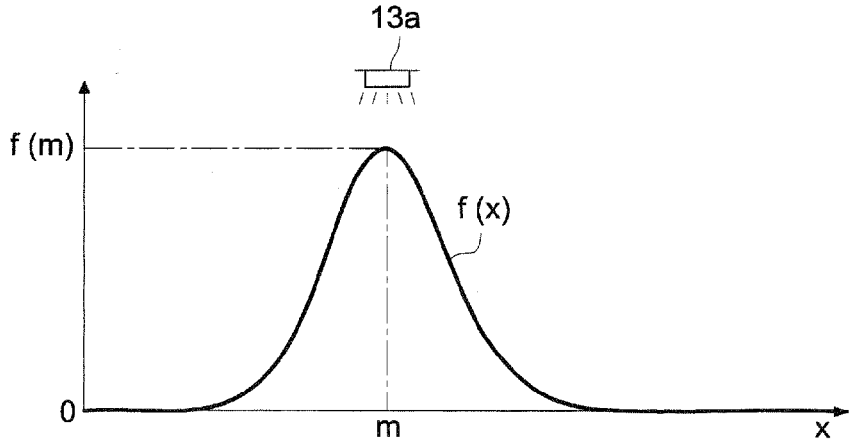
FIG. 5 is a graph showing the illuminance distribution function of a single light source of the LED.

When the illuminance on the substrate S of the ultraviolet light irradiated on the substrate S from the LEDs of the LED light source 12 is measured, the distribution is the normal distribution shown in FIG. 5.

More specifically, as described before, in the case where at the surface of the substrate S under the LEDs 13 of the LED light source 12 which have been arranged in parallel in the sub scanning direction, or in other words in the nozzle row direction of the recording head 10, as shown in FIG. 5; in the illuminance distribution in the x-axis direction of the single light source 13*a* of the LED 13 is x=m, or in other words at the position m of the LED 13*a* of the single light source on the x-axis, the maximum f(m) is shown by the normal distribution of the illuminance distribution function f(x).

It is to be noted that a LED for which the peak illuminance f(m) is variable in accordance with the value of the current flowing thereto is used as the LED 13.

Figure 6:
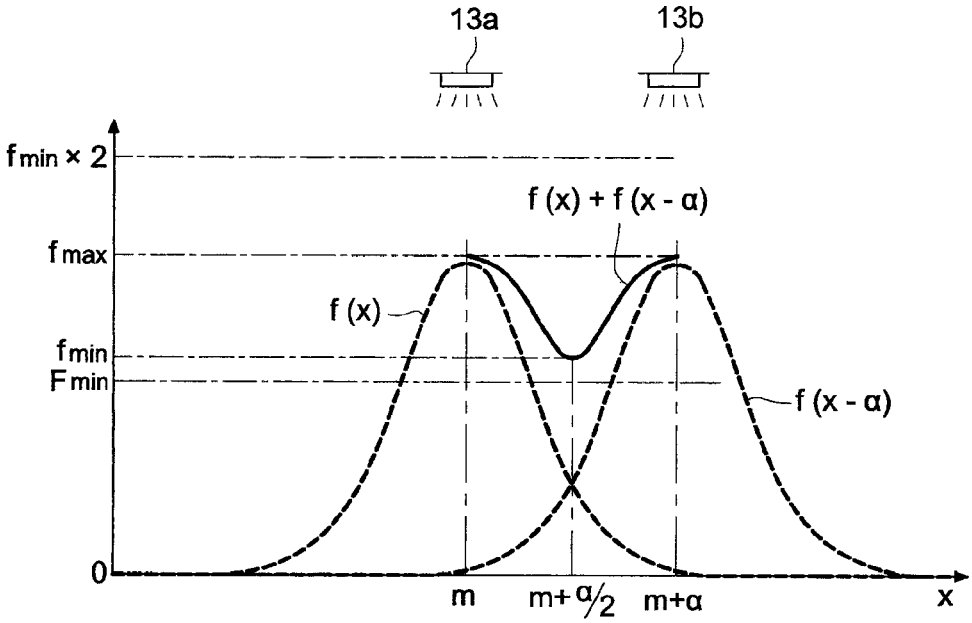
FIG. 6 is a graph showing the illuminance distribution function of two adjacent LEDs.

Also as shown in FIG. 6, in the case where there is an adjacent LED 13*b* which has an interval $\alpha$ in the sub scanning direction with respect to the LED 13*a*, the position on the x-axis of the LED 13*b* is represented by $m+\alpha$ and the illuminance distribution function of the LED 13*b* can be represented by the function for parallel movement of the illuminance distribution function f(x) of LED 13*a* by $\alpha$ in the axial direction or in other words by $f(x-\alpha)$.

In addition, the region on, the substrate S between the two adjacent LEDs 13*a*, 13*b*, or in other words, in the region where $m \leqq x \leqq m+\alpha$, the effect of the other LED on illuminance can be disregarded for the most part, and illuminance can be calculated as the total illuminance of the LEDs 13*a* and 13*b*. Thus, as shown in FIG. 6, the illuminance distribution in this region can be represented by $f(x)+f(x-\alpha)$ in which the illuminance distribution f(x) of the foregoing LED 13*a* and the illuminance distribution $f(x-\alpha)$ of LED 13*b* are totaled.

In the embodiment, as shown in FIG. 6, in the LED light source 12, the total illuminance $f(x)+f(x-\alpha)$ of the two adjacent LEDs 13*a* and 13*b* on the surface of the substrate S is set so as to be larger than the minimum illuminance Fmin required for curing ink in the entire region of section $m \leqq x \leqq m+\alpha$ between the two LEDs 13*a* and 13*b*. That is to say, the minimum fmin of the total illuminance $f(x)+f(x-\alpha)$ is set so as to be larger than the minimum illuminance Fmin required for curing ink. This adjustment is done by adjusting the illuminance of the ultraviolet light for each LED 13 and the interval $\alpha$ in the sub scanning direction X between adjacent LEDs 13.

The minimum illuminance Fmin required for curing ink herein depends on the use of the substrate S on which the images are recorded using the inkjet recording apparatus of the embodiment, but if radical polymerizable ink is used, it is preferable that the minimum illuminance for complete curing immediately after ultraviolet light irradiation is used. In addition, if cation polymerizable ink is used, after ultraviolet light irradiation, minimum illuminance for complete curing after at least one day has elapsed is required, and minimum illuminance for complete curing after about one hour is preferable, while minimum illuminance for complete curing immediately after ultraviolet light irradiation is more preferable.

It is to be noted that complete curing of ink refers to when the lead of an HB pencil is pressed and moved on the coated surface of substrate S using the curing measurement method based on JISK5600-5-4 and the ink is cured to the extent that there are no crack marks on the coated surface.

The LED light source 12 is set such that the maximum fmax of the total illuminance $f(x)+f(x-\alpha)$ in section $m \leqq x \leqq m+\alpha$ becomes less than two times of the minimum fmin at the same time. This adjustment is done by adjusting the interval $\alpha$ in the sub scanning direction X between adjacent LEDs 13.

As is seen from FIG. 6, the total illuminance $f(x)+f(x-\alpha)$ of the two adjacent LEDs 13*a* and 13*b* is the minimum at middle position x between LEDs 13*a* and 13*b*=$m+\alpha/2$. For this reason, in the embodiment, the illuminance on the surface of the substrate S corresponding to the middle position between the two adjacent LEDs 13 in the LED light source 12 is set so as to be an illuminance less than the minimum illuminance Fmin required for curing the ink, and also the illuminance at the position directly under the LEDs on the surface of the substrate S in which total illuminance $f(x)+f(x-\alpha)$ is the maximum fmax, or in other words, illuminance at the position where $x=m$ or $x=m+\alpha$, is set to be less than two times of the illuminance at the middle position between the two adjacent LEDs 13*a* and 13*b*.

It is to be noted that in the examples described below, in this manner, the maximum fmax of the total illuminance $f(x)+f(x-\alpha)$ in the region where $m \leqq x \leqq m+\alpha$ should be less than two times of the minimum fmin and is preferably less than 1.5 times of the minimum fmin.

Figure 11:
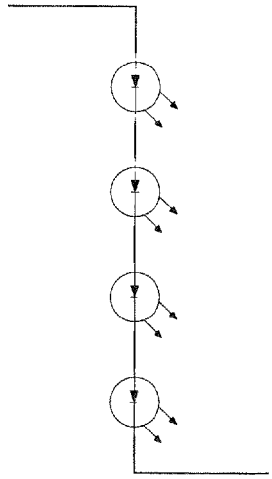
FIG. 11 shows a circuit in which the LEDs are series-connected
Figure 12:
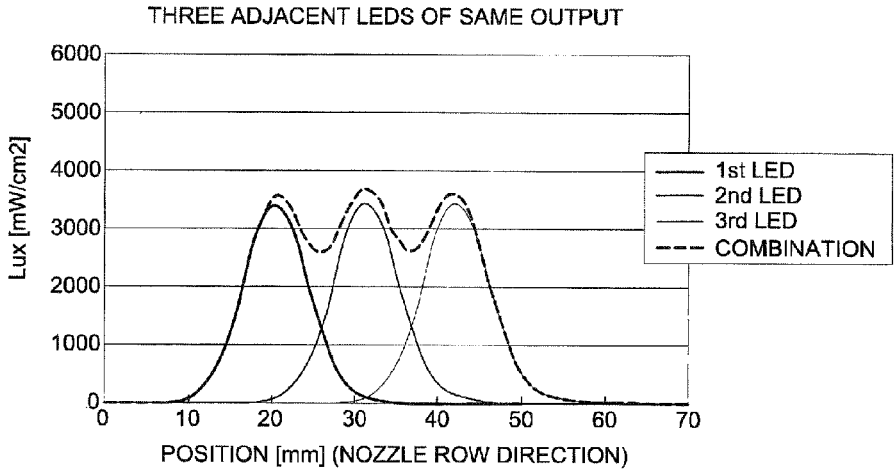
FIG. 12 is a graph showing the illuminance distribution in the case where the output of three adjacent LEDs are the same.
Figure 13:
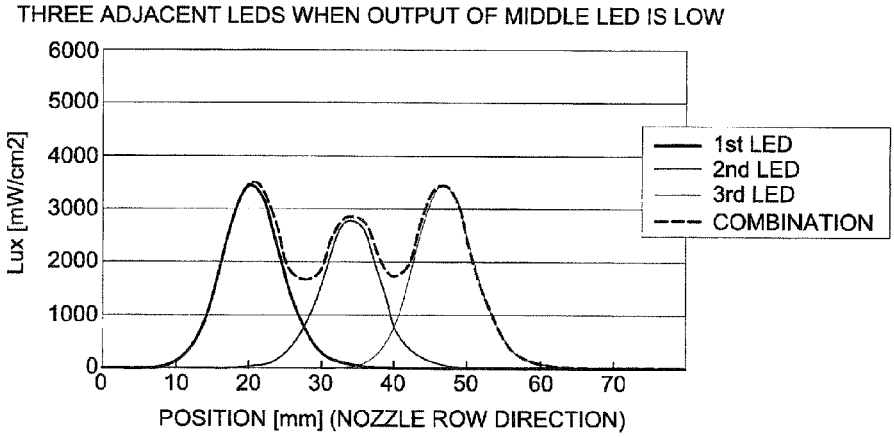
FIG. 13 is a graph showing the illuminance distribution in the case where the output of three adjacent LEDs are different.
Figure 14:
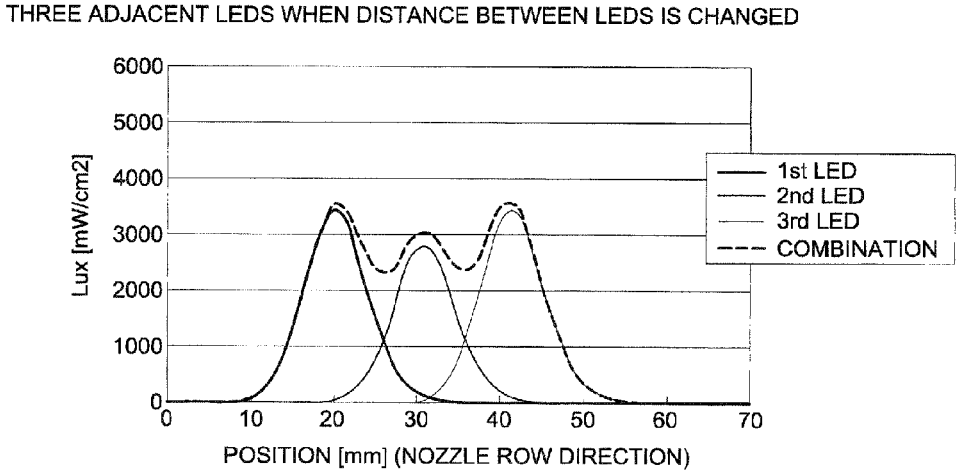
FIG. 14 is a graph showing illuminance distribution when LED arrangement is adjusted in the case where the output of three adjacent LEDs are different.

Though the illuminance distribution of the region on the substrate between the two adjacent LEDs is shown above, it is more preferable to judge the illuminance distribution of whole region of the substrate. In the embodiment, as shown in FIG. 11, the LEDs are electrically series-connected. When the LEDS are electrically series-connected, a control circuit controlling drive current of the LEDs and connection cables of LEDs can be simplified. However, irradiation output varies due to variation in the LEDs. In the case where the outputs of the three adjacent LEDs are the same, the difference between the bottom and the peak of the illuminance distribution which totals illuminance of all the LEDs is small (FIG. 12), but in the case where the output of the middle LED of the three adjacent LEDs is low for example (FIG. 13), the difference between the bottom and the peak of the total illuminance distribution is larger than in the case where the outputs are constant. That is to say, evenness of illuminance is reduced. Thus, by changing the distance between adjacent LEDs in accordance with LED output, the difference between the peak and the bottom in the total illuminance distribution can be reduced (FIG. 14). The maximum fmax of the total illuminance in the whole region on the substrate where the LEDs irradiate should be less than two times of the minimum fmin and is preferably less than 1.5 times of the minimum fmin.

It is to be noted that, in the embodiment, the distance between adjacent LEDs is adjusted, and the irradiation distance from the LED to the substrate also can be adjusted so that the difference between the maximum and the minimum is made small.

As shown in FIG. 4, the LED light source 12 herein may be a plurality of LED light sources 12 arranged in the sub scanning direction X. In the embodiment, as shown in FIG. 2, the range in which the LED light source 12 irradiates ultraviolet light is disposed so as to be larger than the recording width on the substrate S set by the nozzle row on the recording head.

In addition, instead of providing the LED light source 12 at both ends in the main scanning direction Y of the carriage 6 as is the case in this working example, it may be provided at only one side. Furthermore, the LED light source 12 may be provided between the recording heads 10 instead of, or as well, providing the LED light source 12 at both ends or at ones side in the main scanning direction Y of the carriage 6. Also, a light trap for trapping ultraviolet light reflected at the substrate S between the recording head 10 and the LED light source 12 may be suitably provided.

In this case, a minimum of illuminance of the LEDs on a surface of the substrate is larger than an illumination required for curing of the ink in the recording width in an inkjet recording apparatus therefore ink can be sufficiently cured. Further, a maximum of illuminance in the recording width can be lowered to be less than two times of the minimum of illuminance in the recording width, the difference between brightness and density of the ink that received ultraviolet irradiation of maximum illuminance and brightness and density of the ink that received ultraviolet irradiation of minimum illuminance, is eliminated, and good recording images in which brightness unevenness and density unevenness are not remarkable can be obtained.

It is necessary, as mentioned above, to change distance between two adjacent LEDs or to change the irradiation distance from the LEDs to the substrate so that the difference between the maximum of illuminance is less than two times of the minimum of the illuminance.

Next, the effect of the inkjet recording apparatus of the embodiment will be described.

At the time of inkjet recording, the carriage 6 performs the forward or backward movement in the back and forth movement in the main scanning direction on the substrate S that is stationary on the platen 4. The recording head 10 scans the substrate S in accordance with this movement, and the appropriate ink is jetted from the nozzle and an image in the recording width which corresponds to the nozzles of the recording heads 10 is recorded on the substrate S.

When the recording head 10 scans in one main scanning direction and recording is complete, the conveyance rollers rotate and substrate S is conveyed by a prescribed amount in the sub scanning direction X on the platen 4 and then stopped, and when the recording head 10 scans in the opposite direction which is the main scanning direction Y, the conveyance rollers once again conveys the substrate S by a prescribed amount in the sub scanning direction X and then stops it. In this manner, scanning of the recording head 10 in the main scanning direction Y and intermittent conveyance of the substrate S in the sub scanning direction X by the conveyance rollers are performed in tandem and prescribed images are recorded on the substrate S.

Figure 7:
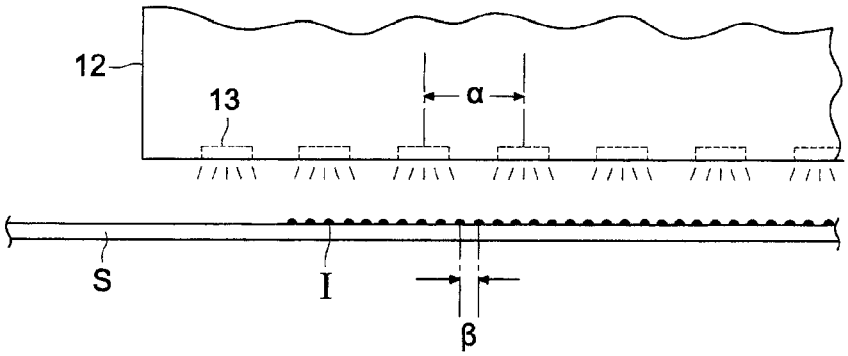
FIG. 7 is a perspective view for explaining the difference in size in the interval between the LEDs and the ink dot intervals.

When the ink is jetted from the nozzle during scanning in one main scanning direction of the recording heads 10, the carriage 6 moves on the stationary substrate S and the LED light source 12 reaches above the ink jetted on the substrate S. At this time, as shown in FIG. 7, the dot interval $\beta$ of the ink I jetted on the substrate S is usually much smaller than the interval $\alpha$ between the LEDs 13 comprising the LED light source 12.

Ultraviolet light of illuminance satisfying the conditions from the LEDs 13 of the light source 12 that has reached above the ink I is irradiated on the ink I which receives this irradiation and is cured and fixed on the substrate S.

That is to say, at least ultraviolet light of illuminance more than the minimum illuminance Fmin required for curing ink on the surface of the substrate S corresponding to the middle position between two adjacent LEDs 13 of the LED light source 12 is irradiated and ultraviolet light of illuminance less than two times of the illuminance at the middle position between the two adjacent LEDs 13 is irradiated at a position directly under each LED. The ink I that has received this ultraviolet light irradiation is cured on the substrate S, and as shown in the example described hereinafter, good recording images are obtained in which brightness unevenness and density unevenness do not occur, or are very little in the case where they occur.

As described above, in the inkjet recording apparatus 1 according to the embodiment, when the interval α between the adjacent LEDs 13*a* and 13*b* of the LED light source 12 is adjusted so that the aforementioned conditions are satisfied, even at the middle position between the two adjacent LEDs of the LED light sources at which the ultraviolet light illuminance is the minimum fmin, sufficient curing of the ink is possible. In addition, because there is little or no difference between the brightness and density of the ink at the position immediately below the LED at which the ultraviolet light illuminance is the maximum fmax and the brightness and density of the ink at the middle position, good recording images are obtained in which there is little or no brightness unevenness or density unevenness and brightness or density unevenness are not outstanding.

At this time as described in the examples below, by satisfying the aforementioned conditions and appropriately keeping illuminance of ultraviolet light at the middle position between the two adjacent LEDs 13 at which the ultraviolet illuminance is the minimum fmin below the minimum illuminance Fmin required for curing ink, there is no adverse effect of the heat generated by light emission from the LED 13 and it becomes possible to keep the increase in temperature of the LED light source 12 such that even if a user touches it, burning does not occur.

Figure 8:
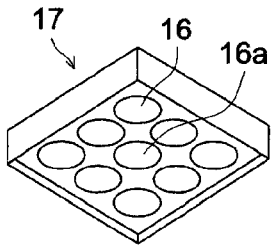
FIG. 8 is a perspective view showing the structure of the LED chip viewed from below.

It is to be noted that in the embodiment, as shown in FIG. 4, the LEDs 13 of the LED light source 12 are respectively single light sources, but for example, as shown in FIG. 8, the LEDs of the LED light source can be provided as LED chips 17 in each which a plurality of LEDs 16 are disposed.

The present invention may be used in this case also. It is to be noted that in this case, the position m of each LED in the aforementioned equation (1) is represented by the center position in each LED chip 17, or in other words, the center LED 16*a* position of the LED chip 17 shown in FIG. 8.

Additionally, the control circuit controlling drive current of LEDs and the wiring to LEDs can be simplified by electrically series-connecting each LED chip 17 comprising a plurality of LEDs wherein each LED is connected in parallel, as disclosed in FIG. 15(*b*) compared with by electrically connecting in parallel each LED chip comprising a multiple of LEDs wherein each LED is connected in parallel, as disclosed in FIG. 15(*a*).

In addition, as described above, the present invention can be used not only when the inkjet recording apparatus is the serial head type, but it may also be used for the line head type inkjet recording apparatus.

Figure 9:
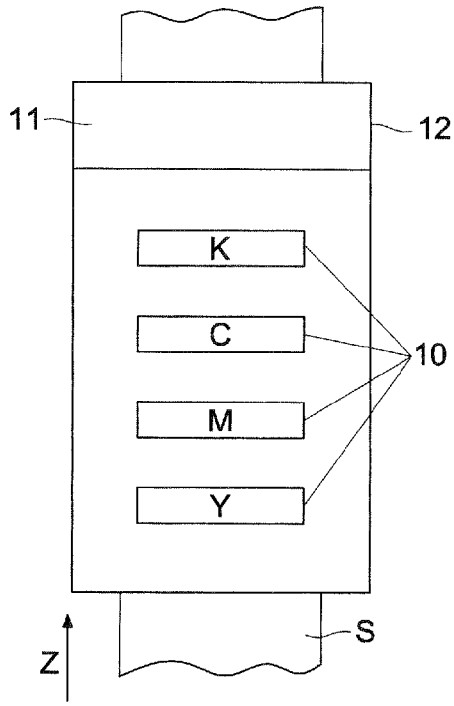
FIG. 9 shows the structure of the line head type inkjet recording apparatus.
Figure 10:
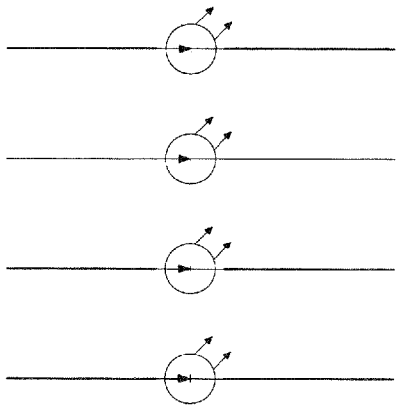
FIG. 10 shows a circuit in which the LEDs are connected in parallel.

In the case where the inkjet recording apparatus is the line head type, as shown in FIG. 9, the substrate S is conveyed in the conveyance direction shown by the arrow Z which crosses the nozzle row direction of the recording head 10 relative to the lower portion of the recording head 10 and the LED light source 12 is arranged at the downstream side in the conveyance direction Z of the recording head 10.

In this case also, the plurality of LEDs of the LED light source that is not shown in FIG. 9 are arranged in parallel rows in the nozzle row direction of the recording head 10, and in the case where the LED raw direction is the x-axis direction, by arranging the LEDs so as to satisfy the aforementioned equation (1), the same effect is obtained as in the case of the serial head type inkjet recording apparatus 1.

EXAMPLES

Description of Experiments

In the experiment, LED light source 12 which has serial head type inkjet recording apparatus 1 at least two LEDs 13 and in which the interval α between the two LEDs is adjusted several times was prepared, and while changing the LED light source 12, only two adjacent LEDs 13 in the sub scanning direction X were turned on and the ink jetted on the substrate S was cured and brightness unevenness and density unevenness of the ink were checked.

[Experiment Conditions]

A PET (polyethylene terephthalate) plate was used on the substrate S and ultraviolet light (half-width approximately 17 nm) has a peak at a wavelength at 365 nm from the two LEDs respectively are irradiated on ink of 25% of each of the colors yellow (Y), magenta (M), cyan (C), black (K), giving a total of 100% that was jetted and spaced closely.

(Ink Used in the Experiment)

The ink for the actual image and the ink for the background image may include anthracene and anthracene derivatives that are wavelength sensitizers for improving the sensitivity of ultraviolet light which has a peak wavelength in the comparatively long wavelength region of 300 nm or more which includes the so-called UV-A wave wavelength region.

Examples of the anthracene derivative include 9,10-diethoxy anthracene, 9,10-dibutoxydianthracene, 2-ethyl-9,10 diethoxyanthracene, 2-tert butyl-9,10-dibutoxyanthracene, 2-ethyl-9,10-bis(2 ethylhexyloxy) anthracene and the like.

The composition of the ink for actual images may include compounds such as the following. Black (K) process color may be formed of the following solutions along with a suitable amount of pigment.

| | |
|---|---|
| Dispersant | 12.5 weight % |
| Various polymerizable compounds | total |
| | 78.7 weight % |
| Denatured silicone oil | 0.2 weight % |
| Basic compounds | 0.1 weight % |
| Photoinitiator propylene carbonate 50% solution | 6.0 weight % |
| Anthracene derivative | 1.5 weight % |
| Naphthalene derivative | 1.0 weight % |

The interval α between the LEDs 13 is adjusted such that the relative value of the total illuminance at the position immediately under the LEDs 13, or in other words, the maximum fmax of total illuminance with respect to the total illuminance at the middle position of the adjacent LEDs 13, or in other words, the minimum fmin of illuminance (see FIG. 6) is changed in 0.25 intervals.

In addition, the illuminance of the LEDs 13 is adjusted such that minimum fmin of the total illuminance is equal to the minimum Fmin required for curing the ink that is used.

[Evaluation Standards]

Evaluation of the experiment results for brightness unevenness and density unevenness were performed visually. The evaluation standard for each is as shown below.

(a) Evaluation Standards for Brightness Unevenness

A Even when viewed closely, there is no brightness unevenness and the quality of the recorded product is good.

B When viewed closely, brightness unevenness is visible, but when viewed from far brightness unevenness was not visible and product is good.

C When viewed closely, there is clearly brightness unevenness, but when viewed from far it was not visible.

D Even when viewed from far there is clearly brightness unevenness.

(b) Evaluation Standards for Density Unevenness

A Even when viewed closely, there is no density unevenness and the quality of the recorded product is good.

B When viewed closely, density unevenness is visible, but when viewed from far density unevenness was not visible and product is good.

C When viewed closely, there is clearly density unevenness, but when viewed from far it was not visible.

D Even when viewed from far there is clearly density unevenness.

[Results]

The experiment results are shown in Table 1 below.

TABLE 1

| | Relative value of fmax with respect fmin | Brightness Unevenness | Density Unevenness |
|---|---|---|---|
| Working Example 1 | 1.25 | A | A |
| Working Example 2 | 1.50 | A | A |
| Working Example 3 | 1.75 | B | B |
| Working Example 4 | 2.00 | B | B |
| Comparative Example 1 | 2.25 | C | C |
| Comparative Example 2 | 2.50 | D | D |

[Evaluation]

As shown in Table 1, in the case when the relative value of the maximum fmax with respect to the minimum fmin of the total illuminance of the two LEDs is increased, as shown in working Examples 1 and 2, at a maximum fmax of total illuminance which is 1.5 times or less of the minimum fmin, and the difference between the minimum fmin and the maximum fmax is not large, neither brightness unevenness nor density unevenness is visible, and extremely favorable results are obtained. In addition, as shown in Working Examples 3 and 4, if maximum fmax of the total illuminance is less than two times of the minimum fmin, this is sufficient for practical use both in view of brightness unevenness and density unevenness.

Meanwhile, as shown in Comparative Examples 1 and 2, if the maximum fmax of the total illuminance exceeds two times of the minimum fmin, even when viewed closely, brightness unevenness and density unevenness are visible, and it was clear that the results obtained were unsuitable for practical use.

It is to be noted that under the conditions for Working Examples 1-4 and Comparative Examples 1 and 2, more (for example 10 or more) LEDs 13 are turned on and the normal recording operation is performed on a larger scale, and experiments for checking heat generation of the LED light source 12 and the reduction in lifespan of the LED 13 itself are performed. The results show that under all the conditions, reduction in lifespan due heating of the LED itself could not be confirmed. Furthermore, it was seen that the temperature of the LED light sources 12 that became relatively high did not become higher than the level at which burning does not occur even if touched by an operator.

It is to be noted that under the conditions of Working Examples 1—Comparative Example 2, when illuminance of the LEDs 13 are increased, the temperature of each LED increases, and because it is clear that the lifespan of the LED decreases due to heat, and thus experiments in which the illuminance of the LEDs are increased were not performed.

According to the embodiment in the application related to an inkjet recording apparatus comprising an LED light source including a plurality of LEDs being electrically series-connected, it is possible for the ink to be sufficiently cured, because the total illuminance of the entire region between two adjacent LEDs is irradiated such that more than the minimum illuminance required for curing the ink is irradiated, In addition, by keeping the maximum of the illuminance at the section between the two LEDs to a illuminance less than two times of the minimum, the difference between brightness and density of the ink that received ultraviolet irradiation of maximum illuminance and brightness and density of the ink that received ultraviolet irradiation of minimum illuminance, is eliminated for the most part and thus even if there is little or no brightness unevenness and density unevenness, good recording images in which brightness unevenness and density unevenness are not remarkable can be obtained.

In addition, at this time as shown in Working Examples, by suitably keeping illuminance of ultraviolet light at the middle position between the two LEDs 13 at a illuminance above the minimum illuminance, there is no adverse effect of the heat generated by light emission from the LED and it becomes possible to keep the increase in temperature of the LED light source such that even if an operator touches it, burning does not occur.

What is claimed is:

1. An inkjet recording apparatus comprising:

a recording head including a nozzle row jetting ultraviolet curable ink on a substrate; and an LED light source including a plurality of LEDs disposed in a direction of the nozzle row, wherein the plurality of LEDs are electrically series-connected, and irradiate an ultraviolet light on the ink having been jetted onto the substrate, wherein a total illuminance of each two adjacent LEDs of the LED light source on a surface of the substrate is larger than an illuminance required for curing the ink in an entire area of a section between each two adjacent LEDs, and a maximum of the total illuminance in the section between each two adjacent LEDs is set to be less than two times a minimum of the total illuminance in the section between each two adjacent LEDs, and wherein at least one of a distance between each two adjacent LEDs and an irradiation distance from the plurality of LEDs to the substrate is set so that the maximum of the total illuminance is set to be less than two times the minimum of the total illuminance.

2. The inkjet recording apparatus according to claim 1, wherein the distance between said each two adjacent LEDs is set so that the maximum of the total illuminance is set to be less than 1.5 times the minimum of the total illuminance.

3. The inkjet recording apparatus according to claim 1, wherein the irradiation distance from the plurality of LEDs to the substrate is set so that the maximum of the total illuminance is set to be less than 1.5 times the minimum of the total illuminance.

4. The inkjet recording apparatus according to claim 1, wherein a range in which the LED light source irradiates the ultraviolet light is set so as to be larger than a recording width on the substrate set by the nozzle row on the recording head.

5. The inkjet recording apparatus according to claim 1, wherein the LED light source includes a plurality of LED chips each of which comprises a plurality of LEDs.

6. An inkjet recording apparatus comprising:

a recording head including a nozzle row jetting ultraviolet curable ink on a substrate; and an LED light source including a plurality of LEDs disposed in a direction of the nozzle row, wherein the plurality of LEDs are electrically series-connected, and irradiate an ultraviolet light on the ink having been jetted onto the substrate, wherein an illuminance at a middle point between each two adjacent LEDs of the LED light source on a surface of the substrate is larger than an illuminance required for curing the ink, and an illuminance at a position of each of said each two adjacent LEDs on the surface of the substrate is set to be an illuminance less than two times the illuminance at the middle point between each two adjacent LEDs, and wherein at least one of a distance between each two adjacent LEDs and an irradiation distance from the plurality of LEDs to the substrate is set so that the illuminance at the position of each of said each two adjacent LEDs on the surface of the substrate is set to be the illuminance less than two times the illuminance at the middle point between each two adjacent LEDs.

7. The inkjet recording apparatus according to claim 6, wherein the LED light source includes a plurality of LED chips each of which comprises a plurality of LEDs.

8. The inkjet recording apparatus according to claim 6, wherein the distance between said each two adjacent LEDs is set so that the illuminance at the position of each of said each two adjacent LEDs on the surface of the substrate is set to be illuminance less than 1.5 times the illuminance at the middle point between each two adjacent LEDs.

9. The inkjet recording apparatus according to claim 6, wherein the irradiation distance from the plurality of LEDs to the substrate is set so that the illuminance at the position of each of said each two adjacent LEDs on the surface of the substrate is set to be illuminance less than 1.5 times the illuminance at the middle point between each two adjacent LEDs.

10. An inkjet recording apparatus comprising:

a recording head including a nozzle row jetting ultraviolet curable ink on a substrate; and an LED light source including a plurality of LEDs disposed in a direction of the nozzle row, wherein the plurality of LEDs are electrically series-connected, and irradiate an ultraviolet light on the ink having been jetted onto the substrate, wherein a range in which the LED light source irradiates the ultraviolet light is set so as to be larger than a recording width on the substrate set by the nozzle row on the recording head, wherein the LED light source irradiates the ultraviolet light so that a minimum of illuminance of the LEDs on a surface of the substrate is larger than an illumination required for curing the ink, and a maximum of illuminance of the LEDs on a surface of the substrate is set to be less than two times the minimum of illuminance in the recording width, and wherein at least one of a distance between each two adjacent LEDs and an irradiation distance from the plurality of LEDs to the substrate is set so that the maximum of illuminance of the LEDs on the surface of the substrate is set to be less than two times the minimum of illuminance of the LEDs on the surface of the substrate.

11. The inkjet recording apparatus according to claim 10, wherein the distance between each two adjacent LEDs is set so that the maximum of illuminance of the LEDs on the surface of the substrate is set to be less than 1.5 times the minimum of illuminance of the LEDs on the surface of the substrate.

12. The inkjet recording apparatus according to claim 10, wherein the irradiation distance from the plurality of LEDs to the substrate is set so that the maximum of illuminance of the LEDs on the surface of the substrate is set to be less than 1.5 times the minimum of illuminance of the LEDs on the surface of the substrate.

13. The inkjet recording apparatus according to claim 10, wherein the LED light source comprises a plurality of LED chips each of which comprises a plurality of LEDs.

* * * * *